US006765137B2

(12) United States Patent
Smart

(10) Patent No.: US 6,765,137 B2
(45) Date of Patent: Jul. 20, 2004

(54) GUITAR BRIDGE LOCK

(76) Inventor: Zachary K. Smart, 4638 Carolina Ave. NE., Salem, OR (US) 97305

( * ) Notice: Subject to any disclaimer, the term of this patent is extended or adjusted under 35 U.S.C. 154(b) by 0 days.

(21) Appl. No.: 10/246,922

(22) Filed: Sep. 18, 2002

(65) Prior Publication Data

US 2004/0051925 A1 Mar. 18, 2004

(51) Int. Cl.[7] ..... G10D 3/00

(52) U.S. Cl. ..... 84/313; 84/298; 84/299; 84/307; 84/312 R

(58) Field of Search ..... 84/313, 298, 299, 84/307, 312 R

(56) References Cited

U.S. PATENT DOCUMENTS

| | | | | |
|---|---|---|---|---|
| 3,248,991 A | * | 5/1966 | Cole | 84/313 |
| 3,252,368 A | * | 5/1966 | Jeffery et al. | 84/313 |
| 3,411,394 A | * | 11/1968 | Jones | 84/313 |
| 4,608,906 A | | 9/1986 | Takabayashi | |
| 4,632,005 A | | 12/1986 | Steinberger | |
| 4,638,711 A | | 1/1987 | Stroh | |
| 4,643,070 A | | 2/1987 | Petrillo | |
| 4,704,936 A | | 11/1987 | Steinberger | |
| 4,724,737 A | | 2/1988 | Fender | |
| 4,763,555 A | | 8/1988 | Minakuchi et al. | |
| 4,843,941 A | | 7/1989 | Nichols et al. | |
| 4,869,145 A | | 9/1989 | Evans | |
| 4,882,967 A | | 11/1989 | Rose | |
| 4,892,025 A | | 1/1990 | Steinberger | |
| 5,986,192 A | | 11/1999 | Wingfield et al. | |

* cited by examiner

*Primary Examiner*—Shih-Yung Hsieh
(74) *Attorney, Agent, or Firm*—Carl D. Crowell

(57) ABSTRACT

An improved floating bridge lock for stringed musical instruments is provided. The improved floating bridge lock comprises a mount and a throw bolt for mounting on a stringed musical instrument. The throw bolt is movable between an inactive position, out of engagement with the floating bridge, and an active position at which it is engaged with the floating bridge. The mount is affixed to a stringed instrument and arranged so that when the throw bolt is in the engaged position, it precludes movement of the floating bridge in a manner that would increase the tension on the strings. When the throw bolt is not engaged, there is free movement of the floating bridge.

7 Claims, 2 Drawing Sheets

Fig. 1
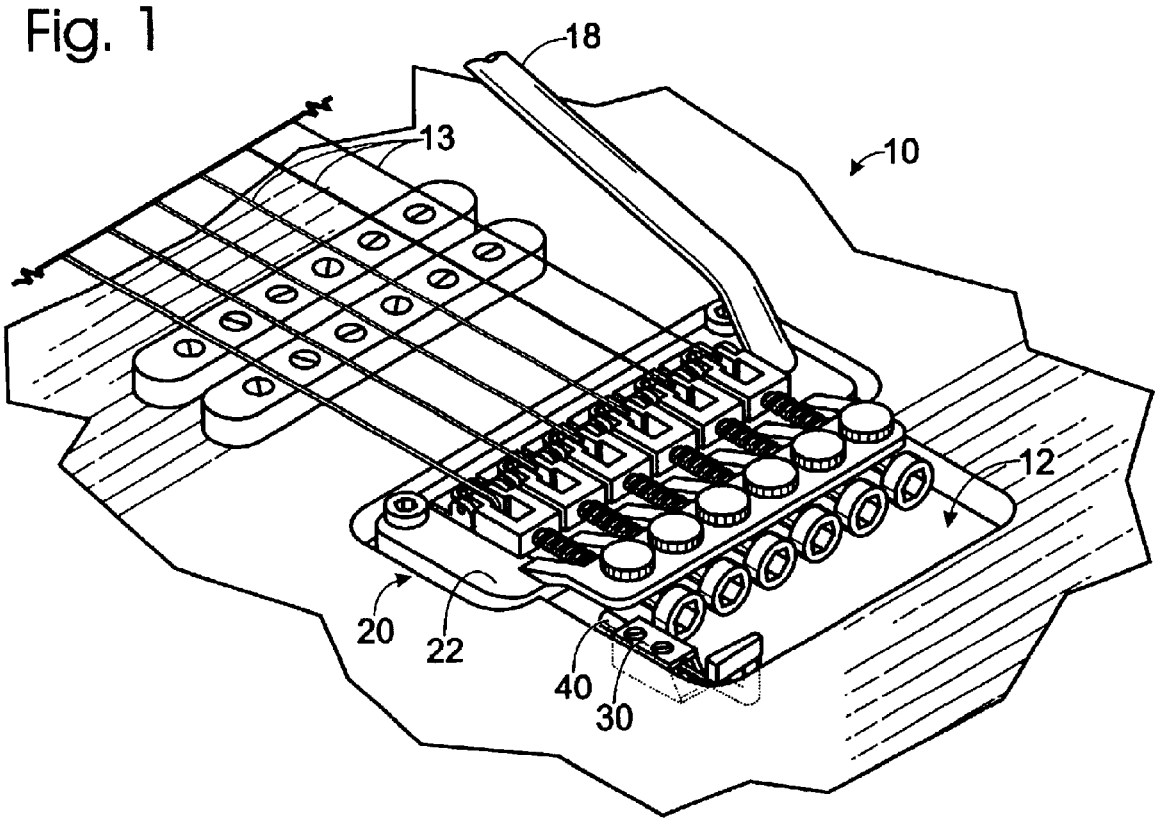
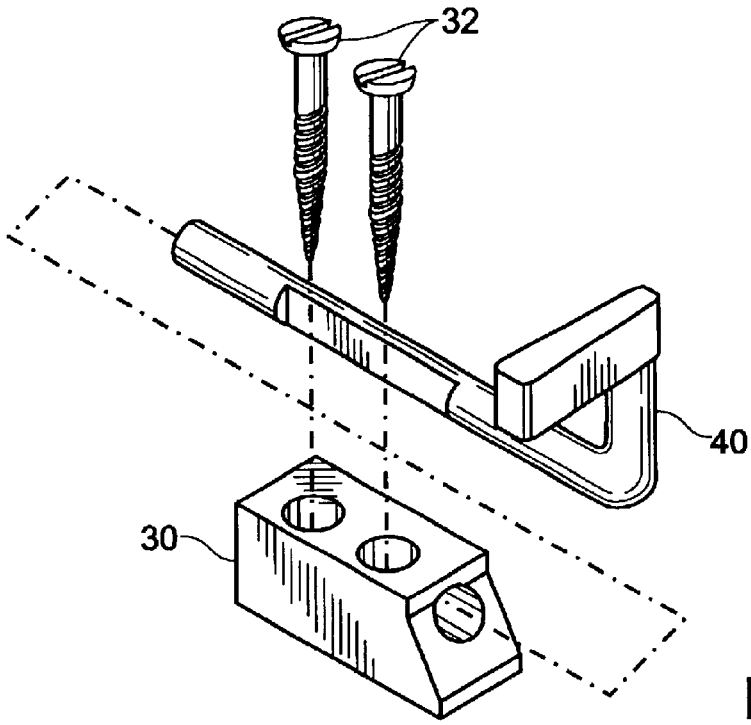
Fig. 2

GUITAR BRIDGE LOCK

BACKGROUND OF THE INVENTION

1. Field of the Invention

This invention relates to a mechanism for use with a floating bridge such as found on guitars and more particularly to a mechanism for converting a full floating bridge to a half or non-floating bridge on electric guitars which include vibrato.

2. Background

An electric guitar with vibrato includes a body, a neck and a head, with strings extending from tuning posts on the head to a vibrato bridge assembly on the body. The floating bridge assembly includes a base plate that is pivotally supported or floating with respect to the body. By pivoting the base plate by means of a vibrato bar, the tension on the strings is altered to vary the pitch of the strings so as to achieve vibrato effects.

The typical floating bridge includes a flange member integral with the base plate that extends downwardly into a cavity in the body of the guitar, at approximately a right angle to the base plate. Springs connected at one of their ends to the lower end of the flange and at the other of their ends to a wall of the cavity in the guitar body. The arrangement allows the strings and the springs counterbalance one another when the strings are in tune and the base plate of the floating bridge is stationary at a neutral position. A vibrato bar is attached to the base plate to allow the user to manually pivot the base plate relative to the guitar body. Pivoting forward reduces the tension on the strings and the tone of the guitar shifts in the flat direction. Pivoting rearward increases the tension on the strings and the tone of the guitar shifts in the sharp direction.

Should one of the strings of the guitar break during use of the guitar, the balance existing between the tension in the unbroken strings and the counterbalancing springs is disturbed. The base plate of the floating bridge pivots rearward due to the tension of the springs until the tension in the remaining unbroken strings again counterbalances the springs. When this occurs the individual tensions in the remaining unbroken strings increase and the tones of the strings all shift in the sharp direction. This creates a problem for a user, especially during a performance for the user who must either stop the performance for a sufficient time to obtain a new guitar or to retune the remaining strings of the guitar in hand.

It is useful and known in the art to provide a bridge that may be selectively locked. Examples of locking bridges are shown in U.S. Pat. No. 4,724,737 to Fender and in U.S. Pat. No. 4,882,967 to Rose.

However, prior art bridge locks are not readily adaptable to existing guitars. In particular, prior art bridge locks are generally not adaptable to guitars with low profile or floating bridges that are placed in a recess in the face of a guitar. Many guitars are collector's items and even considered pieces of art. Extensive modification of a guitar can adversely affect the value and appearance of a guitar. Many prior art bridge locks require significant rebuilding of the guitar or adversely impact the visual appearance of the guitar.

It is a primary object of the present invention to provide such a floating bridge lock in which the base plate can be quickly returned to and held at its original neutral position following the breakage of a string in the instrument so that the user's performance can be continued with only a minor interruption.

Another object of the present invention is to provide a bridge lock that may be used with existing guitars and floating bridges, in particular those guitars with floating bridges placed in a recess in the face of the guitar where access and available space are limited.

Another object of the present invention is to provide a bridge stop to limit floating bridge travel. In some guitars extreme bridge travel permits the strings to come in contact with the body of the guitar deadening the notes. The present invention provides a mount that may be placed such that the mount acts as a stop limiting bridge travel.

Another object of the present invention is to provide a floating bridge lock that is visually and mechanically low profile and does not materially alter the guitar on which it is used.

A further object of the present invention is to provide a floating bridge lock which allows the floating bridge to continue to be used with respect to shifting the base plate to a forward position, wherein the remaining unbroken strings are shifted in the flat direction.

Further objects and advantages of this invention will become apparent as the following description proceeds.

SUMMARY OF THE INVENTION

Briefly stated, and in accordance with one embodiment of this invention, the improved floating bridge lock for stringed musical instruments comprises a mount and a throw bolt to engage the base plate of a floating bridge to which a plurality of strings of the musical instrument are secured. The floating bridge lock is movable between an inactive position in which it is out of engagement with the base plate, and an active position in which it is in engagement with the base plate when the bridge is in the neutral position. The bridge lock is constructed and arranged so that when it is engaged it precludes movement of the floating bridge from the neutral position to the rearward position but allows movement of the floating bridge from the neutral position to the forward position.

The mount of the bridge lock is such that it may be placed within the recess that is commonly found to contain a floating bridge on a modern electric guitar. Placement of the mount may be such that there is no restriction on the movement of the floating bridge, or the mount may be positioned forward to the point of providing a stop to limit travel of the floating bridge, permitting limited rearward movement.

BRIEF DESCRIPTION OF THE DRAWINGS

A better understanding of the present invention will be had upon reference to the following detailed description, when read in conjunction with the accompanying drawings, wherein like reference characters refer to like parts throughout the several views, in which:

FIG. 1 is a perspective view showing the invention in position on an electric guitar type of stringed musical instrument;

FIG. 2 is an enlarged exploded view of the invention shown in FIG. 1;

DETAILED DESCRIPTION OF THE INVENTION

Figure 3:
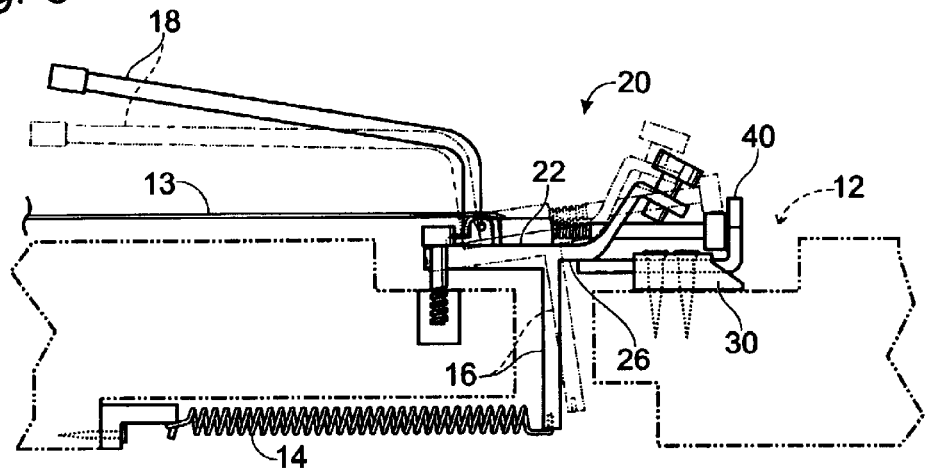
FIG. 3 is a side elevation of the invention in the engaged or locked position, the range of motion of the floating bridge depicted.

Referring to FIG. 1, depicted is a guitar 10 with a recess 12 containing a floating bridge 20. The present invention in use is comprised of a mount 30 and a throw bolt 40. The mount 30 is attached to the guitar proximate the base plate 22 of the floating bridge 20 and the throw bolt 40 is linearly and slidably inserted in the mount 30.

Although the present invention is shown in use on an electric guitar, it should be understood that the invention can be used on other stringed musical instruments, including for example banjos, ukuleles, mandolins, lutes, violins, cellos, and even pianos. The invention is described on a guitar 10 with a recessed 12 floating bridge 20 as this will probably be its greatest use.

FIG. 2 depicts the invention in greater detail with an exploded view. Any number of means including adhesives and mechanical fasteners may be used to affix the mount 20, to the body of the guitar 10. Used in the preferred embodiment and depicted is a pair of screws 32.

When the invention is affixed to the body of a stringed instrument or guitar 10, the mount 30 may be placed within the confines of the recess 12 in which the floating bridge 20 resides. Such placement works to minimize the visual impact of the invention and prevent the invention from interfering with normal play. The mount 30 may be located such that there is no interference with the movement of the floating bridge 20. Alternate placements may also be used such that the mount 30 acts as a stop for the floating bridge 20, permitting limited movement to the rearward position, but preventing extreme movement with would cause the strings 13 to impact the body of the guitar 10.

In FIG. 3, the invention is shown in the engaged position, wherein the throw bolt 40 is in the forward position so as to engage the lower portion of the base plate 26 of a floating bridge 20 converting a full floating bridge to a half floating bridge. The available movement of the bridge 20 in the engaged position is depicted.

Figure 4:
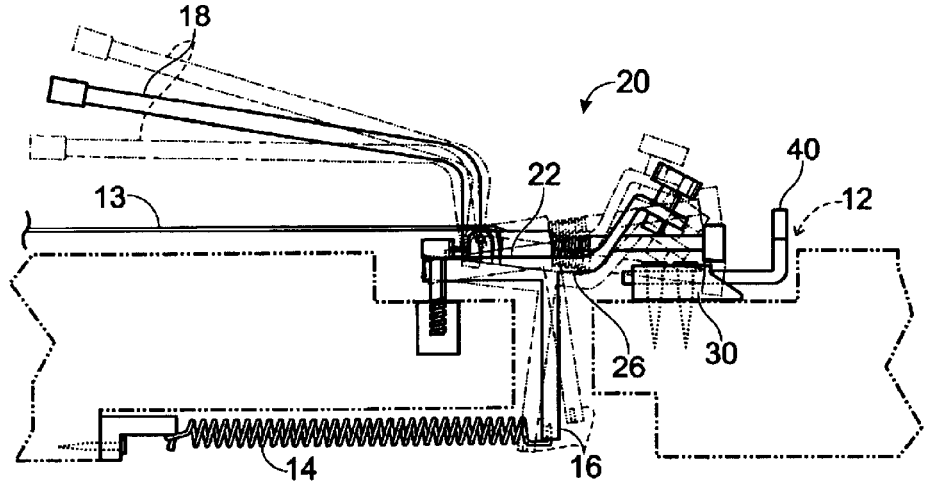
FIG. 4 is a side elevation of the invention in the free position, the range of motion of the floating bridge depicted.

In FIG. 4, the invention is shown in free position, wherein the throw bolt 40 is in the back position so as not to interfere with the movement of the base plate 22 of a floating bridge 20. The full available movement of the floating bridge 20 is as shown.

Operation

A vibrato bar 18 is secured to the base plate 22. When the vibrato bar 18 is moved forward, the bridge supporting base plate 22 pivots or tilts forward about the mounting axis. This action increases the tension of the counterbalancing springs 14 attached to the flange 16 extending from the base plate 22, but reduces the tension on the strings 13, changing the pitch tune of the instrument 10 in a flat direction. When the vibrato bar 32 is moved rearward, the base plate 22 tilts back increasing the tension of the strings 13 and lessening the tension on the counterbalancing springs 14. This sharpens the tune of the instrument 10. When the vibrato bar 32 is released, the equilibrium between the springs 14 and the strings 13 returns the guitar 10 to the original pitch.

Referring to FIGS. 3 and 4, when a string is broken, to return the proper tension in the unbroken strings 13, the throw bolt 40 is moved from the free position FIG. 3, to the engaged position FIG. 4. In the engaged position, the throw bolt 40 engages the backside 26 of the base plate 22 preventing any rearward movement.

From the foregoing description, it will be apparent that this invention provides an improved bridge lock, which permits the immediate retuning of unbroken strings 13 of a stringed instrument 10 when one of the strings breaks during a performance. This is accomplished by allowing the base plate 22 to be returned to and held at the neutral position it originally occupied before the string break, allowing the user's performance to be continued with only a minor interruption. In addition, after being returned to its original neutral position following a string break, the invention allows the base plate 22 of the floating bridge 20 to continue to be shifted forward from the neutral position, allowing the remaining strings 13 to be shifted in the flat direction to provide a continuing tremolo effect.

While there has been shown and described what is presently considered to be the preferred embodiment of this invention, it will be obvious to those skilled in the art that various changes and modifications may be made without departing from the broader aspects of this invention. It is, therefore, aimed in the appended claims to cover all such changes and modifications as fall within the true spirit and scope of this invention.

I claim:

1. An improved floating bridge lock for use with a stringed instrument, the improvement comprising:

providing a floating bridge on a stringed instrument, a mount, a throw bolt, said throw bolt slidably mounted to said mount, said mount affixed to said stringed instrument proximate said floating bridge to permit said throw bolt to slidably engage said floating bridge.

2. The improved floating bridge lock of claim of claim 1 wherein said throw bolt slides linearly in said mount.

3. The improved floating bridge lock of claim 2 wherein said floating bridge is comprised of a base plate with a base plate front side and a base plate back side and wherein said throw bolt engages said base plate back side limiting movement of said floating bridge.

4. The improved floating bridge lock of claim 2 wherein said floating bridge and said mount are contained in a recess in the face of said stringed instrument.

5. A mount for use to limit the travel of a floating bridge on a stringed instrument, said mount affixed to said stringed instrument proximate said floating bridge such that rearward travel of said floating bridge is limited by said mount wherein said mount is a component in a floating bridge lock further comprising a throw bolt, said throw bolt slidably mounted to said mount, to permit said throw bolt to slidably engage said floating bridge.

6. The mount of claim 5 wherein said throw bolt slides linearly in said mount.

7. The mount of claim 5 wherein said floating bridge is comprised of a base plate with a base plate front side and a base plate back side and wherein said throw bolt engages said base plate back side further limiting rearward travel of said floating bridge.

* * * * *